US006111971A

United States Patent [19]

Imahori et al.

[11] Patent Number: 6,111,971

[45] Date of Patent: Aug. 29, 2000

[54] ELECTROACOUSTIC TRANSDUCER

[75] Inventors: Yoshio Imahori; Isao Fushimi, both of Shizuoka, Japan

[73] Assignee: Star Micronics Co., Ltd., Shizuoka, Japan

[21] Appl. No.: 09/022,000

[22] Filed: Feb. 11, 1998

[30] Foreign Application Priority Data

Feb. 12, 1997 [JP] Japan ..... 9-044653

[51] Int. Cl.[7] ..... H04R 25/00

[52] U.S. Cl. ..... 381/412; 381/420; 381/417

[58] Field of Search ..... 381/412, 413, 381/414, 416, 417, 418, 420, 396, 398, FOR 160, FOR 159

[56] References Cited

FOREIGN PATENT DOCUMENTS 2096862 10/1982 United Kingdom ..... 381/FOR 160

*Primary Examiner*—Huyen Le

*Attorney, Agent, or Firm*—Sughrue, Mion, Zinn, Macpeak & Seas, PLLC

[57] ABSTRACT

An electroacoustic transducer, which has a diaphragm, a support member for supporting the diaphragm, a pole piece placed inside the support member and comprising a core and a base, a coil wound around the core, and a magnet placed between the support member and the coil, in which the pole piece or at least the core thereof is made of resin to which a magnetization is applied.

12 Claims, 7 Drawing Sheets

ELECTROACOUSTIC TRANSDUCER

BACKGROUND OF THE INVENTION

1. Field of the Invention

The present invention relates to an electroacoustic transducer, and more particularly, to an electroacoustic transducer, in which a gap between an elastic plate constituting a diaphragm and a top of a pole piece is formed to be extremely precise, and in which the gap length will not vary due to environmental change such as temperature.

2. Description of the Related Art

A structure of an electroacoustic transducer as an example of the prior art is illustrated in FIGS. 13 and 14. There is an upper case 201, and formed at the center of the FIG. 13 is a sound port 203. There is also a lower case 205 under the upper case 201 in FIG. 13, and the lower case 205 and the upper case 201 are welded and fixed by ultrasonic welding. There is an opening 207 formed at the bottom of the lower case 205 in FIG. 13. A base 209 and a core 211 are integrally (namely, the separate parts have been integrated in advance) secured to the opening 207 as a "pole piece" 212. A board 213 is also attached on the bottom surface of the base 209 in FIG. 13.

A coil 215 is wound around the core 211. Coil terminals 215*a* and 215*b* of the coil 215 are respectively secured, for example by means of solder welding, to lead terminals 217 and 219 attached to the board 213. A magnet 223 is placed around the coil 215 with an existence of a ring-like clearance 221 formed in between. The aforementioned lower case 205 is provided, at the inner periphery thereof, with a step portion 225 at which a diaphragm 227 is supported. The diaphragm 227 comprises an elastic plate 228, and a magnetic piece 229 which is attached as an added mass to the center portion of the elastic plate 228. The magnetic piece 229 is welded and fixed, for example by means of spot welding, to the elastic plate 228.

In the thus constituted electroacoustic transducer, the elastic plate 228 integrally provided with the magnetic piece 229, is set to have a given polarity by means of the magnet 223, and hence, is attracted to the magnet 223. When a current flows across the coil 215 via the lead terminals 217 and 219 under this situation, the core 211 is magnetized, generating a magnetic field at the distal end thereof. When the magnetic pole of the core 211 induced by the coil 215 is different from the magnetic pole induced by the magnet 223 attached to the elastic plate 228, the elastic plate 228 is attracted to the core 211. When the magnetic pole of the core 211 induced by the coil 215 is the same as the magnetic pole induced by the magnet 223 attached to the elastic plate 228, the elastic plate 228 repels the core 211.

Consequently, by allowing the current to intermittently flow in either direction, the elastic plate 228 repeats the above-discussed operation. In other words, the elastic plate 228 vibrates at a given frequency, thus generating a sound.

In regard to the electroacoustic transducer having the above discussed structure and function, each constituent part thereof is classified into a "structural section", a "magnetic circuit section", an "electromagnetic coil section" and an "acoustic circuit section" according to the function.

In detail, the structural section includes the lower case 205, the base 209, the elastic plate 228 and the core 211.

Similarly, the magnetic circuit section includes the base 209, the elastic plate 228, the core 211 and the magnet 223.

The electromagnetic coil section includes the coil 215, the lead terminals 217 and 219, and the board 213.

For reference, the identical part may be included in different sections at the same time.

With regard to the constituent parts which belong to the magnetic circuit section, the magnetic flux from the magnet 223 as well as the magnetic flux by magnetomotive force from the coil 215 are required to effectively be induced in the magnetic circuit. Thus the constituent parts included in the magnetic circuit section, namely, the base 209, the elastic plate 228, the core 211 and the magnet 223, are made of material having high magnetic permeability, like metal such as steel or nickel.

Further, as for the constituent parts which belong to the structural section, the following conditions are required. Firstly, with regard to the elastic plate 228, the efficient vibration by means of magnetic force between the magnetic circuit section and the electromagnetic coil section is required, hence the elastic plate 228 is required to have remarkable flexibility as well as rigidity. Secondly, with regard to the other constituent parts in the structural section, a gap between the elastic plate 228 and the core 211 (as shown by letter L in FIG. 13) is required to be extremely precise, as well as to prohibit variation of length of gap L due to environmental change such as temperature. Therefore the constituent parts in this section may preferably be made of high-workability engineering plastic material, such as polyphenylene oxide (PPE), nylon, liquid crystal polymer (LCP), etc.

However, as above discussed, the base 209, the elastic plate 228, and the core 211 in the structural section also belong to the magnetic circuit section, and because of functional priority to be the parts of the magnetic section, the high magnetic-permeability material such as steel or nickel (i.e. metal) is ordinarily used for these parts.

As for the lower case 205, which is in the structural section but in the magnetic circuit section, the engineering plastic material such as PPE, nylon, LCP is used.

The above discussed prior art has the following problem.

As discussed above, in the case of the electroacoustic transducer in the prior art, the pole piece 212 is made of metal, and on the other hand, the lower case 205 is made of engineering plastic material such as PPE, nylon, LCP. Accordingly, when the dimension of each part varies due to change in temperature, etc., since the thermal expansion rate of each part is different, the amount of variation of dimension (especially the amount thereof in the axial direction) becomes different from each other, thereby the length of the gap L in FIG. 13 between the elastic plate 228 and the core 211 varies. When the length of the gap L varies, the acoustic characteristic such as sound pressure or frequency may also vary, and eventually the desirable acoustic characteristic may not be obtained.

SUMMARY OF THE INVENTION

It is an object of the present invention to provide an electroacoustic transducer, in which a gap between a diaphragm and a top of a pole piece is formed to be extremely precise, and which may obtain a stable acoustic characteristic by prohibiting such a variation of gap length.

To achieve the object mentioned above, according to the present invention, there is provided an electroacoustic transducer, which has a diaphragm, a support member for supporting the diaphragm, a pole piece located inside the support member and comprising a core and a base, a coil wound around the core, and a magnet located between the support member and the coil, in which the pole piece or at least the core thereof is made of resin to which a magnetization is applied.

Preferably, the support member may be made of resin.

Preferably, the magnetization may partially and selectively be applied to the pole piece.

Preferably, the pole piece may be in a shape to enlarge a gross area of application of magnetization without changing the thickness of the pole piece.

For this purpose, the base and the core of the pole piece may have uneven surfaces, the core may have at least one cut groove, or the core may have at least one hole.

Preferably, the resin may be an engineering plastic material such as polyphenylene oxide (PPE), nylon, liquid crystal polymer (LCP), etc., and the magnetization may be applied by plating, adhesion of laminated foils, coating of paste of magnetic material, or mixing of magnetic powder.

Preferably, the magnetic material for the magnetization may be Ni—Fe alloy, of which ratio may correspond to 75%–25%.

With this structure, the whole body of the pole piece or at least the core thereof is made of resin to which the magnetization is applied. Therefore, for example, when the whole body of the pole piece is made of resin, the pole piece may integrally be formed, thus the gap may be formed to be remarkable precise length. When at least the core thereof is made of resin, the facile assembly to the base may be obtained. In addition, since the pole piece is made of resin, the workability may improve, thereby the pole piece may become thinner, more complicated shape, and lighter.

Additionally, when the supporting member is made of resin, the supporting member and at least the core of the pole piece are made of the same material, thereby the length of the gap between the elastic plate and the top of the pole piece will not vary even if there is any variation in dimension due to environmental change such as temperature.

Further, when the resin-made pole piece is provided in a shape with an enlarged area of magnetization without changing the thickness of the pole piece, the area of the magnetic path is enlarged, so the efficiency of magnetic force may improve, thus the frequency characteristic may improve (namely, the frequency band width may become wider). In addition, the equivalent efficiency of magnetic force may be obtained by thinner application of the magnetic material, thereby the pole piece may become thinner, which contributes to minimization of the electroacoustic transducer.

Further, when the resin-made pole piece is provided with the magnetization partially or selectively applied, it is possible to adjust the efficiency of magnetic force, thereby the adjustment of frequency characteristic can be made.

BRIEF DESCRIPTION OF THE DRAWINGS

The invention will be described below in detail with reference to the accompanying drawings, in which.

DETAILED DESCRIPTION OF THE INVENTION

First Embodiment

Figure 1:
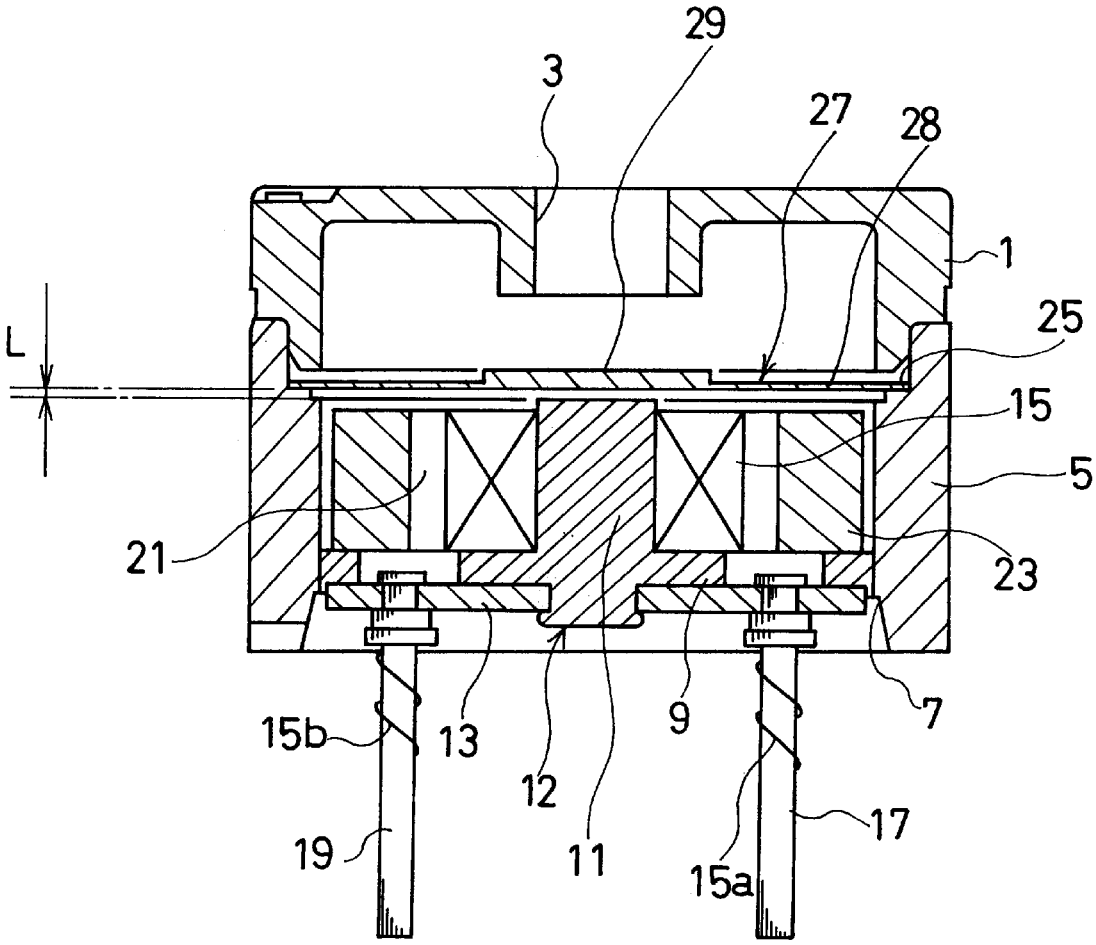
FIG. 1 is a sectional view showing an overall structure of an electroacoustic transducer according to a first embodiment of the present invention.

A first embodiment of the present invention will now be described with reference to FIGS. 1 through 5. As illustrated in FIG. 1, there is an upper case 1, and a sound port 3 is formed at the center of the upper case 1. The upper case 1 and a lower case 5 positioned under the upper case 1 are welded and fixed by ultrasonic welding. The lower case 5 has an opening 7 at the bottom thereof in FIG. 1. A base 9 and a core 11 have been formed integrally to serve as a "pole piece" 12, and a board 13 is attached on the bottom surface of the base 9.

A coil 15 is wound around the core 11. Coil terminals 15*a* and 15*b* of the coil 15 are respectively secured, by means of solder welding, for example, to lead terminals 17 and 19 attached to the board 13. A magnet 23 is placed around the coil 15 with an existence of a ring-like clearance 21 formed in between. The aforementioned lower case 5 is provided, at the inner periphery thereof, with a step portion 25 at which a diaphragm 27 is supported. The lower case 5 serves as a supporting member for the diaphragm 27. The diaphragm 27 comprises a flat plate member 28 as an elastic plate, and an added mass member 29 as a magnetic piece which has been integrally formed at the center portion of the flat plate member 28.

Figure 2:
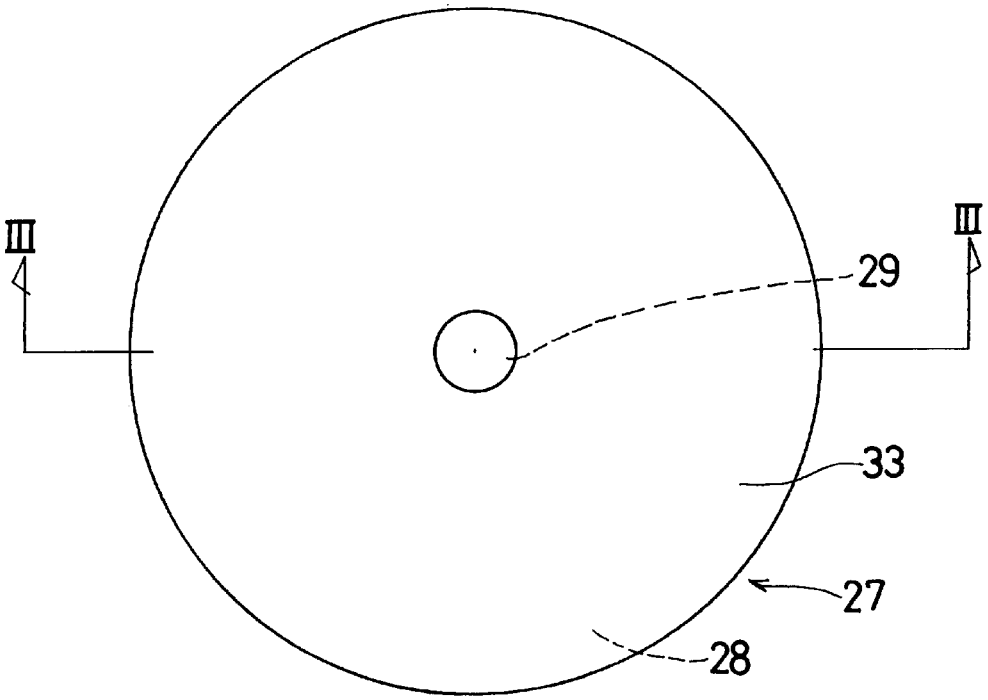
FIG. 2 is a plan view of a diaphragm according to the first embodiment of the present invention.
Figure 3:
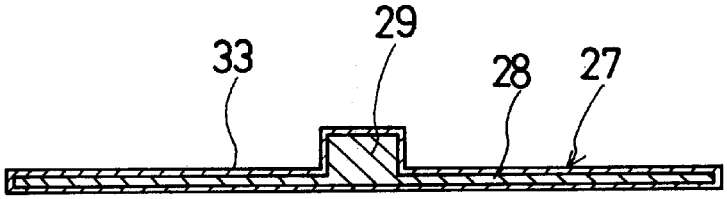
FIG. 3 is a cross-sectional view of the first embodiment taken along the line III—III in FIG. 2.

The structure of the diaphragm 27 will now be described in detail with reference to FIGS. 2 and 3. In the present embodiment, as above discussed, the flat plate member 28 and the added mass member 29 are integrally formed to serve as the diaphragm 27. The diaphragm 27 may be made of engineering plastic material such as polyphenylene oxide (PPE), nylon, liquid crystal polymer (LCP), etc. A magnetic material 33 is applied to the whole surface of the diaphragm 27.

The method of application of the magnetic material 33 to the diaphragm 27 is not limited to plating. For example, an adhesion of laminated foils, or a coating of paste of magnetic material, may be utilized. Further, there may be a mixture of magnetic powder and the engineering plastic material such as PPE, nylon, LCP, without providing a layer of the magnetic material 33.

For example, the magnetic material 33 is made of Ni—Fe alloy, of which preferable ratio may correspond to 75%–25%. In order to perform the necessary function as a magnetic circuit, the thickness of application should substantially be equivalent to the thickness of the flat plate member 28 (in particular, several tens of $\mu$m).

It is clear that the above is an example of the present embodiment, thus the substance and thickness of the magnetic material 33 may be decided mutatis mutandis.

Figure 4:
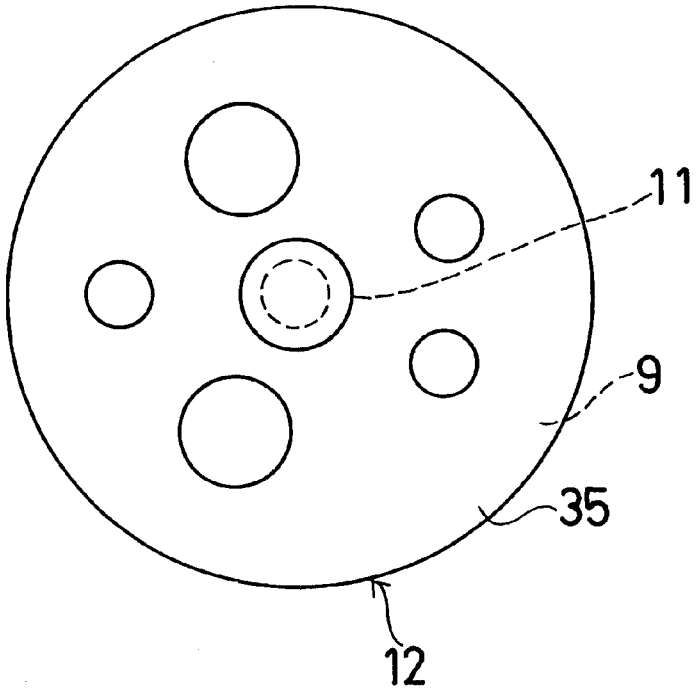
FIG. 4 is a plan view of a pole piece according to the first embodiment of the present invention.
Figure 5:
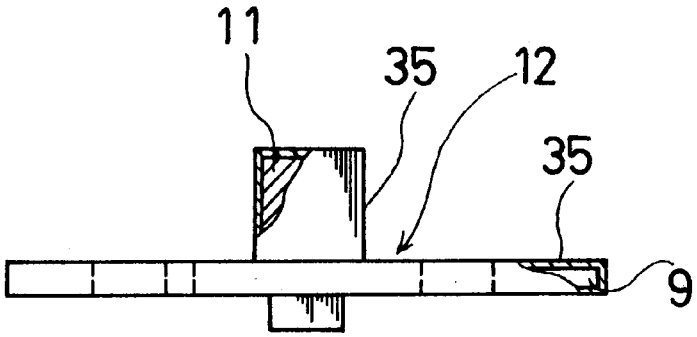
FIG. 5 is an elevational view of the pole piece with a part thereof cut away according to the first embodiment of the present invention.

The structure of the pole piece 12 will now be described in detail with reference to FIGS. 4 and 5. Like the case of the above mentioned diaphragm 27, the base 9 and the core 11 are integrated to serve as the pole piece 12, of which material is the engineering plastic such as PPE, nylon, LCP. The outer surface of the pole piece 12 comprising the base 9 and the core 11 is provided with a layer of a magnetic material 35. The ingredient of the magnetic material 35 is the same as the case of the diaphragm 27.

Since the function of the present embodiment as the electroacoustic transducer is the same as that of the prior art, the explanation thereof will not be made.

The present embodiment has the following merits.

Firstly, in the present embodiment, the pole piece 12 is integrally made of engineering plastic material such as PPE, nylon, LCP. The lower case 5 is also made of engineering plastic material such as PPE, nylon, LCP. In the thus described structure, it is possible to prohibit the variation of length of a gap (as shown by letter L in FIG. 1) due to environmental change such as temperature. Namely, since the lower case 5 and the pole piece 12 are both made of engineering plastic material such as PPE, nylon, LCP, the amounts of thermal distortion thereof (especially in the axial direction) due to change in temperature become equal to each other, thereby the constant length of gap L may be maintained. Accordingly, the stable acoustic characteristic may be obtained.

Secondly, since the pole piece 12 is integrally formed, the number of parts may be reduced, thereby the facile quality control may be accomplished. Further, as the pole piece 12 is made of resin, the workability thereof may improve, thereby the pole piece 12 may become thinner, more complicated shape, and lighter.

Second Embodiment

Figure 6:
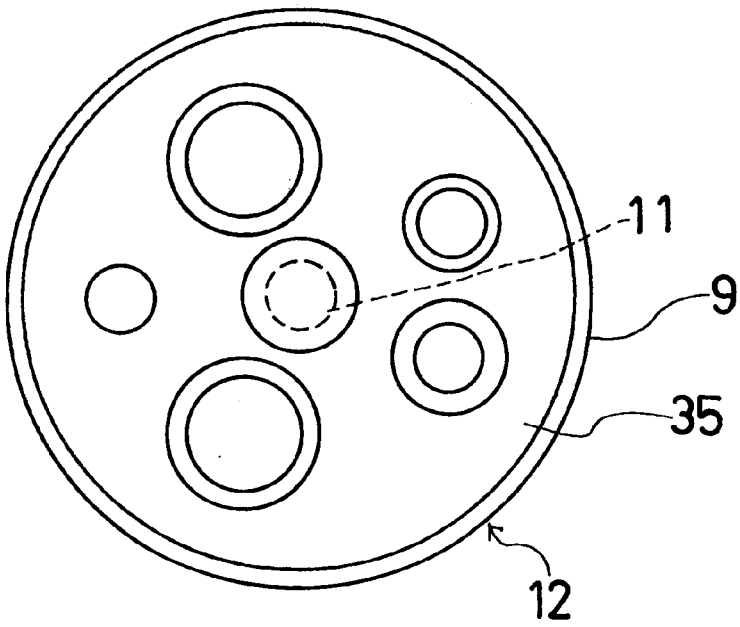
FIG. 6 is a plan view of a pole piece according to a second embodiment of the present invention.
Figure 7:
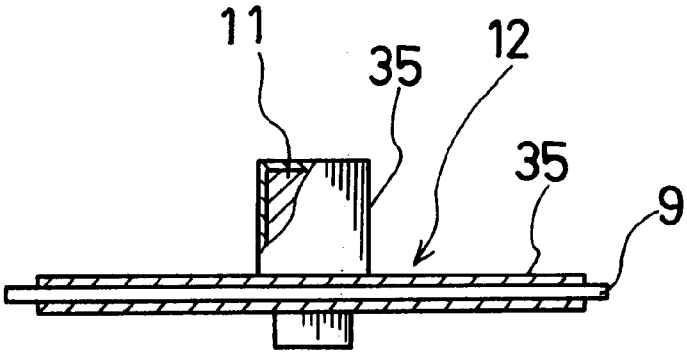
FIG. 7 is an elevational view of the pole piece with a part thereof cut away according to the second embodiment of the present invention.

A second embodiment of the present invention will be described with reference to FIGS. 6 and 7. In the first embodiment as above discussed, the layer of the magnetic material 35 is thoroughly provided on the outer surface of the pole piece 12 comprising the base 9 and the core 11. However, according to the second embodiment, the layer of the magnetic material 35 is partially provided. In particular, the portion around the outer peripheral edge of the base 9 is exposed without application of the magnetic material 35.

According to the second embodiment in which the magnetization is partially or selectively applied to the pole piece 12 made of resin, it is possible to adjust the efficiency of magnetic force, thereby the adjustment of frequency characteristic can be made.

Third Embodiment

A third embodiment of the present invention will be described with reference to FIGS. 8 and 9. In the first embodiment as above discussed, the flat plate member 28 of the diaphragm 27 is in a flat shape. However, according to the third embodiment, the flat plate member 28 has a plurality of (in the present embodiment, three) ring grooves 31.

Figure 8:
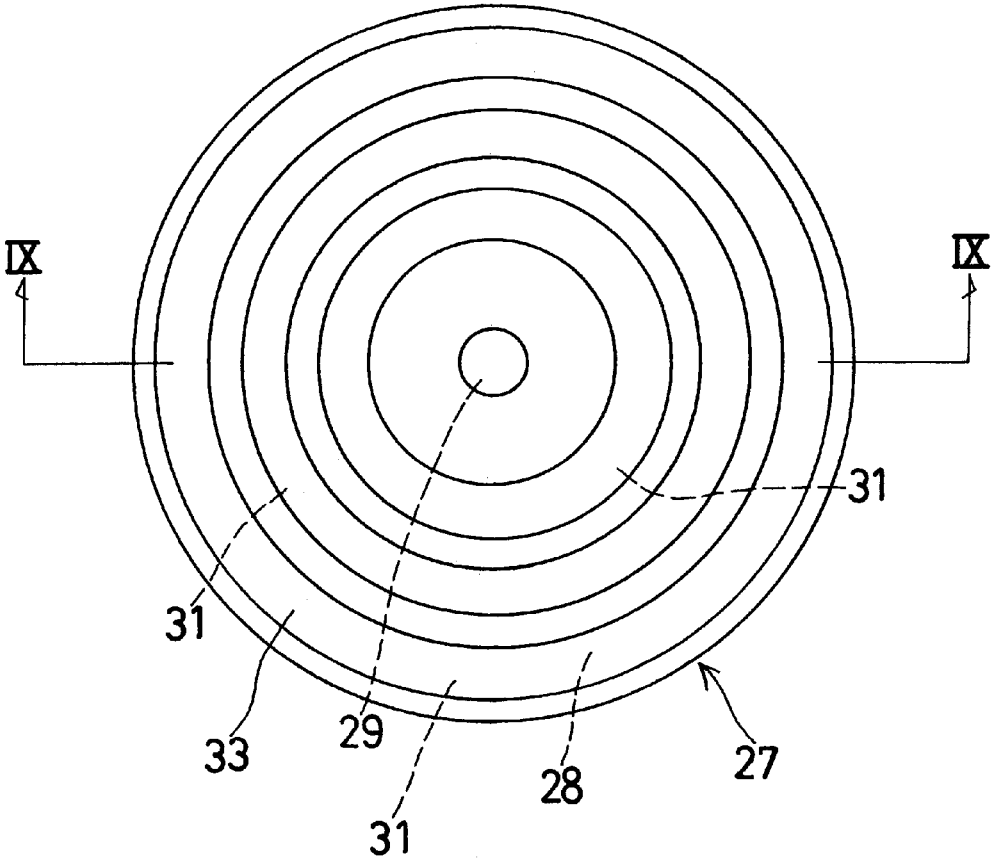
FIG. 8 is a plan view of a diaphragm according to a third embodiment of the present invention.
Figure 9:
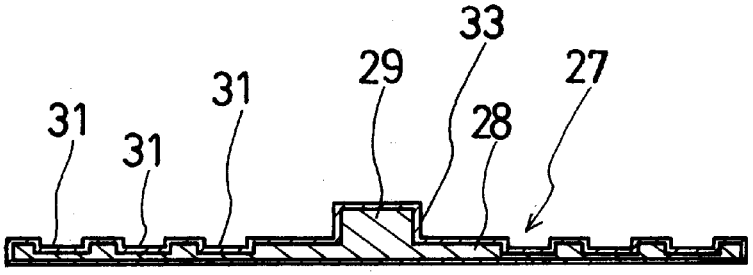
FIG. 9 is a cross-sectional view of the third embodiment taken along the line IX—IX in FIG. 8.

According to the third embodiment as shown in FIGS. 8 and 9 in which the plurality of ring grooves 31 are provided on the flat plate member 28 of the diaphragm 27, the gross area of application of the layer of the magnetic material 33 is enlarged, thus the area of the magnetic path is also enlarged, thereby the efficiency of magnetic force may improve. In addition, the equivalent efficiency of magnetic force may be obtained by thinner application of the layer of the magnetic material 33.

Fourth Embodiment

Figure 10:
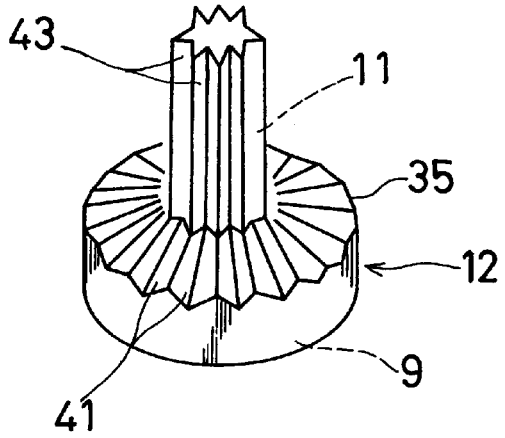
FIG. 10 is a perspective view showing a structure of a pole piece according to a fourth embodiment of the present invention.

A fourth embodiment of the present invention will be described with reference to FIG. 10. In the fourth embodiment, there is provided a different shape of the pole piece 12. Namely, there is an uneven portion 41 on the upper surface of the base 9, and also an uneven portion 43 on the cylindrical surface of the core 11. Accordingly, the gross area of application of the layer of the magnetic material 35 is enlarged, thus the area of the magnetic path is also enlarged, thereby the efficiency of magnetic force may improve. In addition, the equivalent efficiency of magnetic force may be obtained by thinner application of the layer of the magnetic material 35.

Fifth Embodiment

Figure 11:
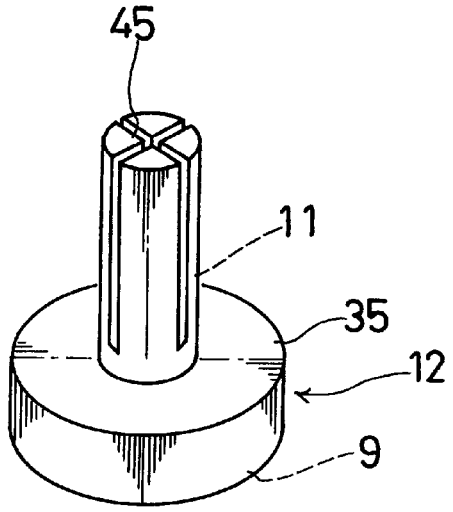
FIG. 11 is a perspective view showing a structure of a pole piece according to a fifth embodiment of the present invention.

A fifth embodiment of the present invention will be described with reference to FIG. 11. In the fifth embodiment, there is provided another shape of the pole piece 12. Namely, there are cross-shaped cutting grooves 45 in the core 11. Accordingly, the gross area of application of the layer of the magnetic material 35 is enlarged, thus the area of the magnetic path is also enlarged, thereby the efficiency of magnetic force may improve, and the equivalent efficiency of magnetic force may be obtained by thinner application of the layer of the magnetic material 35.

Sixth Embodiment

Figure 12:
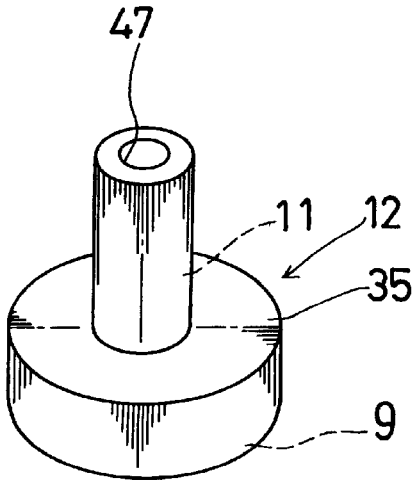
FIG. 12 is a perspective view showing a structure of a pole piece according to a sixth embodiment of the present invention.
Figure 13:
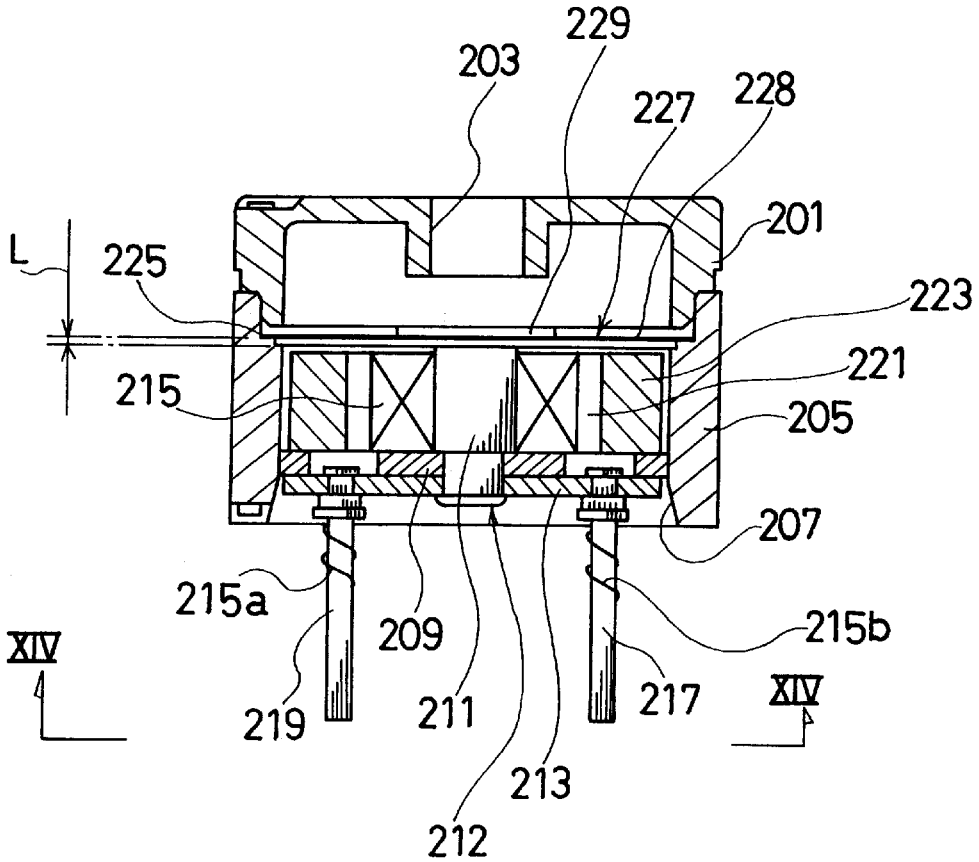
FIG.13 (PRIOR ART)
FIG. 13 is a sectional view of an electroacoustic transducer according to a prior art.
Figure 14:
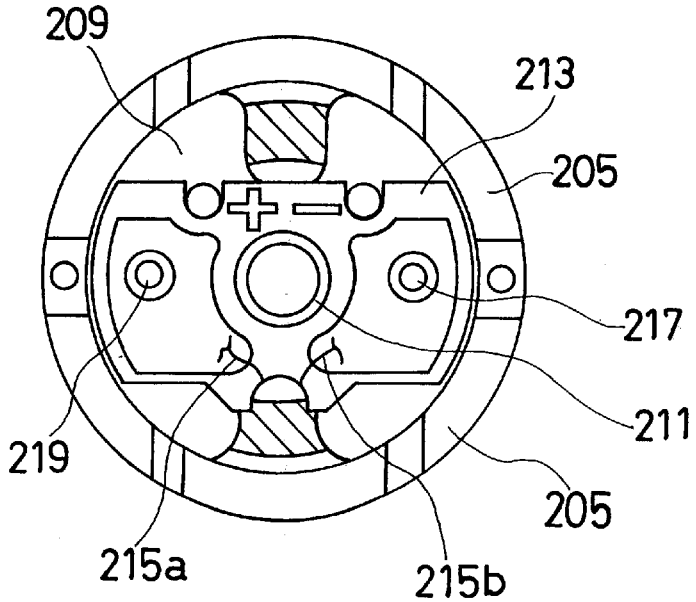
FIG.14 (PRIOR ART)
FIG. 14 is a view of the prior art as viewed from an arrow XIV—XIV in FIG. 13.

A sixth embodiment of the present invention will be described with reference to FIG. 12. In the sixth embodiment, there is provided still another shape of the pole piece 12. Namely, there is a hole 47 in the core 11. Accordingly, the gross area of application of the layer of the magnetic material 35 is enlarged, thus the area of the magnetic path is also enlarged, thereby the efficiency of magnetic force may improve, and the equivalent efficiency of magnetic force may be obtained by thinner application of the layer of the magnetic material 35.

The present invention is not limited to the first through sixth embodiments as described above.

Firstly, it is absolutely an arbitrary element of the present invention whether resin is used for the diaphragm 27.

The present invention is characterized in that the pole piece 12 is made of resin. Such pole piece 12 has higher workability so that it may be integrally formed, and the gap with the diaphragm 27 may be extremely precise. Further, if the supporting member is also made of resin, the pole piece 12 and the supporting member show an equal distortion due to an environmental change, so the precise gap may be still maintained.

Secondly, in the above embodiments, the pole piece 12 is wholly made of resin. However, it is sufficient that at least the core 11 of the pole piece 12 is made of resin, by which the variation of length of gap due to the environmental change can be prohibited.

Thirdly, in the above embodiments, the lower case 5 serves as a supporting member. However, the diaphragm 27 may also be supported via a support ring, and the present invention may also be applied to various structures of electroacoustic transducer which are known per se.

What is claimed is:

1. An electroacoustic transducer comprising:

a diaphragm;

a support member for supporting said diaphragm;

a pole piece placed inside said support member, said pole piece comprising a core and a base, wherein at least said core of said pole piece is made of resin;

a layer of magnetic material covering the resin of said pole piece;

a coil positioned around said core; and a magnet placed between said support member and said coil.

2. The electroacoustic transducer as claimed in claim 1, wherein said support member is made of resin.

3. The electroacoustic transducer as claimed in claim 1, wherein said layer of magnetic material is partially and selectively applied to said pole piece.

4. The electroacoustic transducer as claimed in claim 1, wherein said pole piece is shaped such that a gross area of application of said layer of magnetic material is enlarged without changing a thickness of said pole piece.

5. The electroacoustic transducer as claimed in claim 4, wherein said base and said core of said pole piece are shaped to have uneven surfaces.

6. The electroacoustic transducer as claimed in claim 4, wherein said core of said pole piece is shaped to have at least one groove.

7. The electroacoustic transducer as claimed in claim 4, wherein said core of said pole piece is shaped to have at least one hole.

8. The electroacoustic transducer as claimed in any one of claim 1 to claim 7, wherein said layer of magnetic material is applied by one of the means of plating, adhesion of laminated foils, coating of paste of magnetic material, and mixing of magnetic powder.

9. The electroacoustic transducer as claimed in claim 8, wherein said layer of magnetic material is a Ni—Fe alloy.

10. The electroacoustic transducer as claimed in claim 9, wherein a ratio of said Ni—Fe alloy corresponds to 75%–25%.

11. The electroacoustic transducer as claimed in any one of claim 1 to claim 7, wherein said resin is an engineering plastic material.

12. An electroacoustic transducer comprising:

a diaphragm;

a pole piece comprising a core and a base, said core being spaced at a predetermined distance from said diaphragm;

a coil positioned around said core; and a magnet surrounding said coil, wherein at least said core of said pole piece is made of resin, and wherein a layer of magnetic material is provided to coat said resin of said pole piece.

* * * * *